United States Patent [19]

Korenowski et al.

[11] 4,118,295

[45] Oct. 3, 1978

[54] REGENERATION OF PLASTIC ETCHANTS

[75] Inventors: Theodore Frank Korenowski, Zelienople; Leslie Emery Lancy, Ellwood City, both of Pa.

[73] Assignee: Dart Industries Inc., Los Angeles, Calif.

[21] Appl. No.: 676,941

[22] Filed: Apr. 20, 1976

[51] Int. Cl.[2] ..... C02C 5/12

[52] U.S. Cl. ..... 204/151; 204/97; 204/149; 204/180 P

[58] Field of Search ..... 204/97, 149, 151, 180 P, 204/129.1

[56] References Cited

U.S. PATENT DOCUMENTS

| | | | |
|---|---|---|---|
| 3,481,851 | 12/1969 | Lancy | 204/180 P |
| 3,682,796 | 8/1972 | Bedi et al. | 204/97 |
| 3,728,238 | 4/1973 | Tarjanyi et al. | 204/97 X |
| 3,730,864 | 5/1973 | Tarjanyi et al. | 204/149 |
| 3,761,369 | 9/1973 | Tirrell | 204/151 |
| 3,764,503 | 10/1973 | Lancy et al. | 204/151 X |
| 3,909,381 | 9/1975 | Ehrsam | 204/180 P |
| 4,006,067 | 2/1977 | Gussack | 204/151 |

*Primary Examiner*—Arthur C. Prescott

*Attorney, Agent, or Firm*—Margareta LeMaire; Bryant W. Brennan; Fred S. Valles

[57] ABSTRACT

A method useful in the regeneration of a spent chromic acid-sulfuric acid plastic etch solution and also in the recovery of such etchant chemicals from rinse water associated with a plastic etching process, which method involves an electrolytic treatment, in which oxidation of trivalent chromium impurities to the serviceable hexavalent state takes place simultaneously with expulsion of organic impurities from the solution.

10 Claims, 2 Drawing Figures

REGENERATION OF PLASTIC ETCHANTS

BACKGROUND OF THE INVENTION

Figure 1:
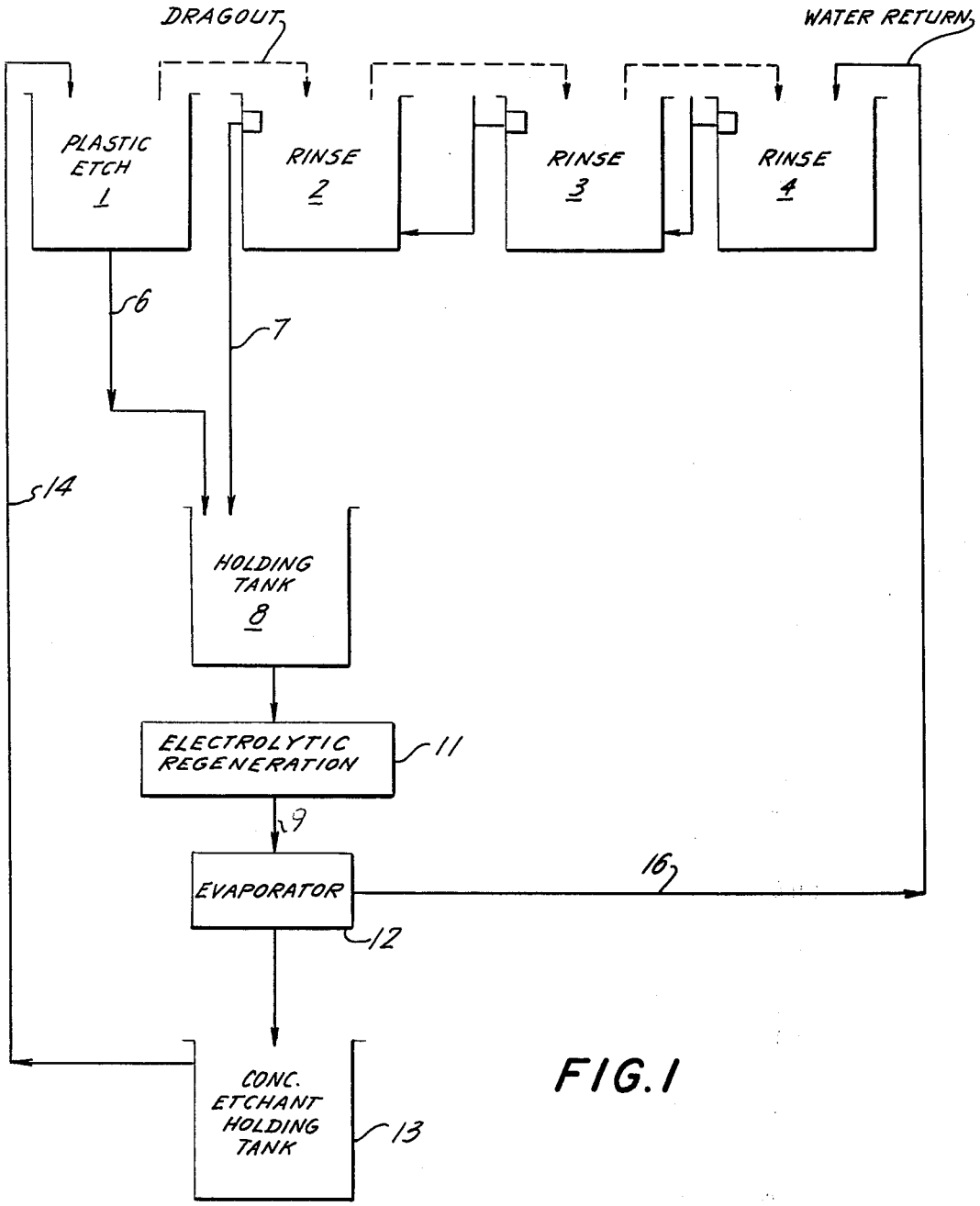

The present invention provides a method for regenerating mixtures of chromic and sulfuric acids that are used for etching plastics prior to metallic plating. Additionally, this invention furnishes a unique method for substantially recovering and regenerating etchant chemicals which are commonly lost to rinse waters associated with plastic etching processes.

In the practice of plating on plastic, it is frequently required that the plastic substrate be chemically etched or deglazed prior to plating operations. In this manner, the hydrophobic nature of the plastic is reduced and a roughened surface is provided which promotes better adhesion of metal deposits. Although many mechanical and chemical means for depolishing plastics are employed in the art, it is commonly recognized that an aqueous solution containing primarily chromic and sulfuric acids can serve as a general and suitable etchant for plastics such as acrylonitrile-butadiene-styrene (ABS), polyethylene, polystyrene, polypropylenes, phenolics, epoxies, polysulfones, acrylics, polycarbonates, phenylene oxides, and others. The chromium trioxide content usually ranges between about 1 and about 30 percent by weight in these chromic-sulfuric acid etchants. Hexavalent chromium compounds other than chromium trioxide, such as potassium dichromate, may be used to establish the $Cr^{+6}$ concentration.

In some systems additional reagents, such as phosphoric acid, also may be included in this type etchant to aid in the production of certain desired surface qualities; but, in all cases, the activity of these various etchant formulations depends upon the oxidative attack of the plastic by hexavalent chromium and the ability of sulfuric acid to solubilize the polymeric materials. However, in a given bath, the etching capacity is soon attenuated by the accumulation of dissolved organic materials and trivalent chromium. The organics reside as fractured units of the original polymer and the trivalent chromium results from oxidation-reduction reactions that occur between hexavalent chromium and the plastic substrate. Typically, when reduced etching activity is noted, or when these impurities reach a certain predetermined level, a process solution of this type is discarded in favor of a fresh bath.

Throughout the industry, it is recognized that dumping of such etchants is extremely wasteful, as the spent solution may contain as much as 70 to 90 percent of the original hexavalent chromium content. Not only does the loss of these values contribute significantly to the overall cost of the etching process, but dumping also adds to this cost in that these etchants present a substantial waste treatment problem. At a minimum, the highly toxic hexavalent chromium must be reduced to the trivalent form and, thereafter, removed from solution. Commonly, trivalent chromium is removed from solution by addition of alkalies to form a voluminous precipitate of chromium hydroxide which requires dewatering before ultimate disposal on land. Substantial losses and waste treatment requirements are created also due to dragout of etchant chemicals from the process bath into subsequent rinse water. Simple attempts to recover these chemicals by evaporation of rinse waters and reuse of residual chemicals in the process has limited value as this may serve to concentrate and return the detrimental impurities.

THE INVENTION

Figure 2:
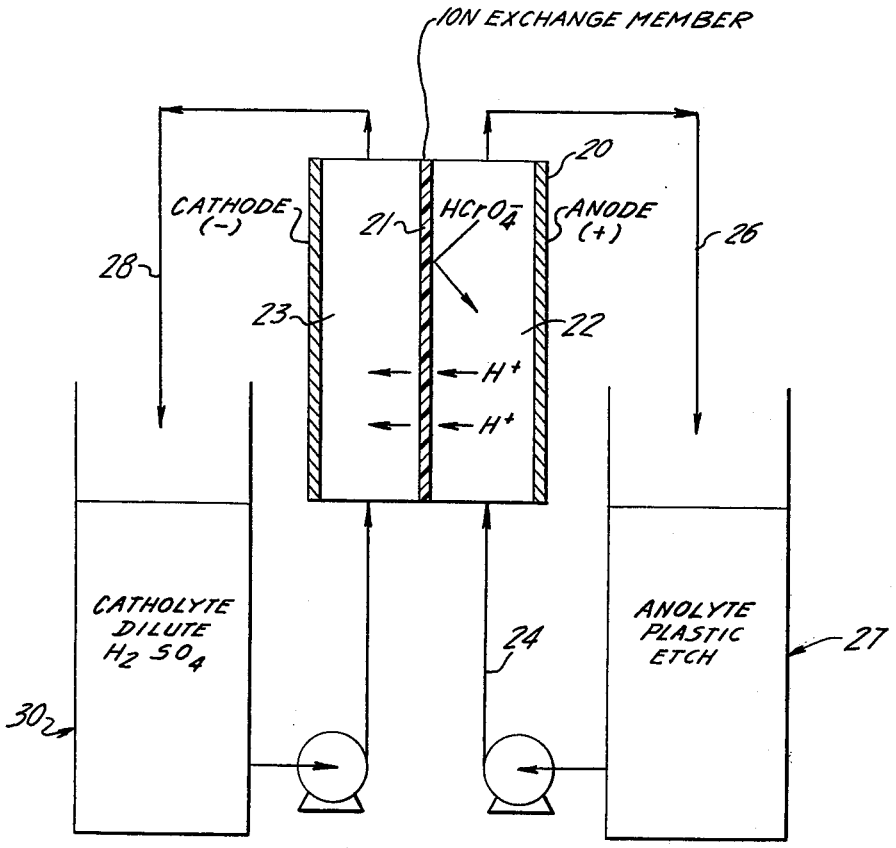

In the drawings,

FIG. 1 shows a schematic diagram for regeneration of a plastic etch solution according to the invention, and FIG. 2 shows a schematic sectional view of an electrolytic cell useful in the regeneration.

A method overcoming the difficulties discussed before has now been found whereby organic and trivalent chromium impurities can be removed from chromic-sulfuric acid etchants and the rinse waters associated with these processes. This technology permits regeneration of this type etchant and effective chemical recovery from rinse water common to these systems. Primarily, it has been identified that this regeneration and recovery can be achieved by application of a special electrolytic technique described hereinafter which enables oxidation and expulsion from solution of organic contaminants (presumably as carbon dioxide and other volatile products) and the reoxidation of trivalent chromium to the servicable hexavalent form. In this electrochemical aspect of the process, the desired oxidation reactions are executed in an anode compartment of an electrochemical cell which is selectively isolated by a permselective membrane from competitive reduction reactions which can occur at the cathode of the cell.

Direct electrolysis of spent chromic-sulfuric acid etchants to achieve the desired oxidation reactions is possible; however, these solutions are known to be extremely corrosive. Therefore, it is desirable that the concentration of such etchants be reduced, e.g. by dilution with water before they are subjected to the electrochemical regeneration. Such dilutions permit use of more conventional materials for electrolytic cell construction and enable employment of a unique scheme for recovery of etchant chemicals normally lost to rinse waters. In a preferred system, waters used in rinsing operations following the etching process are reused to dilute the concentrated etch prior to the electrolytic regeneration. In this manner, chemicals contained in the rinse water are directly returned to the etch solution. Following removal of impurities by electrolysis, the dilute solution may be reconcentrated and returned to the etching process. Of course, the process is also applicable to direct recovery and regeneration of etchant chemicals from rinse waters alone.

Further, it has been found that this reconcentration step causes additional removal of residual organic material that remains after electrochemical regeneration. The controlled application of heat during concentration promotes oxidation-reduction reactions between soluble organics and hexavalent chromium. In these reactions, the organic moieties are expelled from solution as carbon dioxide and other volatilies, and minor amounts of trivalent chromium are generated. The quantity of trivalent chromium created in this step is relatively small and the concentrated etch solution may be returned directly to the etching process without further purification. In fact, a process can be envisioned wherein this regeneration scheme is applied in a continuous fashion to hold the trivalent chromium and organic impurities at a certain low level, thereby establishing a solution that gives predictable and reproducable etch rates. This would substantially simplify the etching process by eliminating the obvious extremes that occur between the use of a freshly prepared bath and one that is near exhaustion.

FIG. 1 provides a graphic representation of one possible regeneration system integrated in a plastic etching process. Work pieces are etched in plastic etch tank 1 and then rinsed in a three-stage counter current rinsing sequence, wherein the work pieces are rinsed in rinse tanks 2, 3, and 4 (the line of travel of the work pieces indicated by the broken lines) and the rinse water first enters tank 4 and then overflows into tank 3 and finally into tank 2. A stream 6 of the plastic etch solution is continuously withdrawn from the etch tank 1 and combined with the overflow 7 from rinse tank 2. In this fashion, a diluted etch solution is supplied to a holding tank 8 from which a steady flow of solution 9 is taken for electrolytic regeneration 11, evaporation 12, and delivery to a concentrated etchant holding tank 13. The concentrated, regenerated etchant 14 is then supplied to the etching station 1 at a rate required to compensate for the volume of plastic etch taken for regeneration. As indicated, water 16 removed during the evaporation phase may be returned for reuse in the rinsing operation. Many variations on this represented continuous regeneration scheme may be contemplated and, indeed, in some cases a semi-continuous or batch-type process incorporating the above-described recovery principles may represent the most economical and feasible system.

Many sophisticated and complex cell designs can be envisioned for achieving the desired electrolytic regneration; however, the essential requirements for any such cell are displayed schematically in FIG. 2. As shown, the cell 20 must be divided by an ion exchange membrane 21 so as to create separate anode and cathode chambers 22 and 23. This membrane should be of the available types which contain selective ion exchange resins impregnated in a chemically resilient film vehicle such as a perfluoropolymer. Further, the ion exchange resins contained in the membrane must be cation selective; that is, the membrane should allow transfer of positive ions between the anode and cathode chambers, but inhibit similar migration of anions. The presence of a permselective membrane is of substantial importance as one major objective of the electrolysis process is to achieve oxidation of trivalent chromium ions to a hexavalent form. This oxidation reaction which occurs at the anode of the cells is represented in general form by Reaction (1).

$$Cr^{+3} + 4H_2O - 3e^- \rightarrow HCrO_4^- + 7H^+ \quad (1)$$

As can be seen, the product of this electrolytic reaction is an oxy-anion which contains chromium in the hexavalent state. Since the overall charge of this ion is negative, the selective cation exchange barrier in the cell prohibits transfer of this negative ion to the cathode where hexavalent chromium could be reduced again to the trivalent form as shown by Reaction (2).

$$HCrO_4^- + 7H^+ + 3e^- \rightarrow Cr^{+3} + 4H_2O \quad (2)$$

Thereby, when a spent chromic-sulfuric acid etchant 24 is applied as an anolyte (solution in the anode chamber) in such a cell, the electrolytic oxidation of trivalent chromium impurities to the serviceable hexavalent form can proceed without competition from electrochemical reduction reaction. To support the reduction phenomena required to complete the electrochemical couple, a dilute acid solution, such as a 5 to 15 percent by volume sulfuric acid solution, may be utilized as a catholyte (the solution in the cathode chamber). In this manner, hydrogen ions are directly supplied to the cathode for facile reduction to elemental hydrogen and electrical communication between the two-cell compartments is established by the permissable transfer of positively charged hydrogen ions from the anode chamber to the cathode chamber.

Additionally, FIG. 2 indicates recirculation of the separate anolyte and catholyte solutions respectively by means of line 26, tank 27 and line 28, tank 30. This is not a strict requirement of this electrolysis as the desired reactions would eventually be accomplished if these solutions were maintained in a substantially static condition. However, agitation provided by recirculation or other potential mechanical stirring means is known to enhance efficiency in electrochemical processes as the resultant turbulence serves to supply the electrodes with reactive ionic species. Also, it is commonly recognized that most electrochemical reactions are accelerated as the temperature of the electrolytes is increased. This is assignable to the well-established observation that mobility of dissolved ionic species is enhanced in increased solution temperatures. In the present invention, it is preferred that some form of mechanical agitation be applied to the anolyte and potentially the catholyte solution, and that the electrolysis reaction be conducted at elevated temperatures of at least 20° C. with a preferred range being about 60° to 80° celsius. However, when working with concentrated spent etch solutions, lower temperatures, such as 20° to 40° C., are more desirable so as to attenuate or limit corrosion.

As solutions containing chromic and sulfuric acids are known to be extremely corrosive, the selection of an anode material for use in the regeneration is recognized to be particularly important. Investigations indicated that the following materials can be utilized as anode compounds in the above-described electrochemical process:

(a) lead,
(b) alloys of at least 90 percent by weight of lead with another metal, such as antimony, silver, tellurium, tin or mixtures thereof, as the remaining portion of the alloy,
(c) lead peroxide when applied as a surface coating on carbon or metallic substrates,
(d) platinum or
(e) platinum coated substrates such as platinized graphite, platinized titanium, platinized tantalum, etc.

The materials listed in (a), (b), and (c) above are particularly well suited in the method of this invention, as it was found, that their use enhances the efficiency for conversion of trivalent chromium to the hexavalent state.

Also, in working with spent plastic etch solution, it was noted in every case that the amount of trivalent chromium impurity found by direct analyses showed only a portion of the total potential trivalent chromium content. That is, when a given sample of etch solution was heated, it was found that the trivalent concentration increased to a certain limiting value. It was reasoned and confirmed by total organic carbon analyses that this increase corresponded to oxidation and elimination of dissolved organics. Table 1 below displays the results of heating three samples of a spent etch solution at different temperatures for a period of 2.5 hours.

TABLE 1

Effect of Temperature on $Cr^{+3}$ Content

TABLE 1

| Effect of Temperature on $Cr^{+3}$ Content | | |
|---|---|---|
| Temp. ° C | $Cr^{+3}$ Initial-g/l | $Cr^{+3}$ Final-g/l |
| 64 | 46.2 | 47.5 |
| 90 | 46.2 | 51.4 |
| 116 | 46.2 | 62.4 |

As seen, the trivalent chromium increased in every case, with the greatest increase occurring at the highest temperature (reflux conditions). More important though, it was noted that no further increase in trivalent chromium concentration was obtained when continuing the heating of the solution at 116° C. for periods greater than 2.5 hours and thus, the limiting concentration had been reached.

In the experimental work, such limiting values for trivalent chromium were considered in judging the effectiveness of the total regeneration process. Work with electrolytic regeneration of spent plastic etch solutions indicated that a substantial portion of this "hidden" trivalent chromium impurity was eliminated during electrolysis. Initially, it was assumed that this effect was due to the fact that the electrolysis reactions were conducted at elevated temperatures in the range of 60° to 80° Celsius. However, in view of data such as those presented in Table 1, it soon was obvious that minor amounts of organic contaminants were being removed by thermally-promoted reactions, and that direct electrolytic oxidation of organic materials was achieved.

To promote the elimination of organic impurities from spent etch solutions, rinse waters or mixtures thereof, a separate heating step can be employed either before or after the electrolysis. Temperatures generally in the range of about 70° to about 150° C. should then be employed at a suitable pressure including subatmospheric, ambient and elevated pressures.

For a further understanding of the invention reference is had to the following examples.

EXAMPLE I

A solution containing 400 grams per liter of each of $CrO_3$ and $H_2SO_4$ was used to etch sheets of ABS plastic (acrylonitrile-butadiene-styrene) at a temperature of 60° C. This etching process was continued until the etch solution accumulated approximately 46 grams per liter of trivalent chromium. At this point, a sample of the solution was taken and diluted with an equal volume of water to reduce its corrosive nature and then subjected to electrolytic regeneration. This diluted solution was recirculated through the anolyte compartment of an electrolytic cell wherein a current density of 10 amps per square decimeter was applied to a C.P. lead anode. In this cell, a DuPont XR cation exchange membrane was used to separate the anode and cathode chambers and a 5 percent by volume solution of sulfuric acid was utilized as a static catholyte solution in the cathode compartment. A stainless steel cathode was employed in this cell. Throughout the electrolysis the temperature of the anolyte was maintained in the range of 60° to 70° C. At the end of 2.5 hours of electrolysis, it was found that approximately 67 percent of the initial concentration of trivalent chromium content was converted to the hexavalent form. Based on the utilization of applied amp-hours of electricity, it was determined that an apparent efficiency of 60 percent was obtained for conversion of chromium from the trivalent to the hexavalent form.

EXAMPLE II

As in Example I, a solution of 400 grams per liter of each of $CrO_3$ and $H_2SO_4$ was employed to etch panels of ABS plastic until the accumulated concentration of trivalent chromium was found to be 51 grams per liter. This concentrated spent etch was subjected directly to electrolysis without dilution. In this electrochemical regeneration experimental conditions and materials employed in cell construction were essentially identical with the exceptions that a platinized titanium anode was used and the electrolysis was conducted at 22° C. This lower temperature was used due to the extremely corrosive nature of this concentrated etch solution. Following 3 hours of electrolysis with an anode current density of 10 amps per square decimeter, it was found that an apparent efficiency of 22% was achieved in the utilization of electric current for the desired oxidation reaction.

EXAMPLE III

To examine the applicability of a number of anode materials for use in this process, a solution of 400 grams per liter of each of $CrO_3$ and $H_2SO_4$ was used to etch ABS materials until the accumulated trivalent chromium concentration reached 50 grams per liter. This solution was then diluted by one-half with water to reduce its corrosive nature. Following this, a number of portions of the resultant solution were subjected to electrochemical regenerations in which various anode materials were empolyed in a cell that provided for static anolyte and catholyte solutions. In every case, a solution containing 10 percent by volume of $H_2SO_4$ was used as a catholyte and a stainless steel cathode was employed. Also, a current density of approximately 2 amps per square decimeter was applied to the anode and a temperature of about 70° C. was maintained in every trial. Based on the utilization of applied amp-hours of electricity for oxidation of trivalent chromium, the following apparent efficiencies were obtained for the various anode materials:

| Anode Material | Current Efficiency $Cr^{+3} \rightarrow Cr^{+6}$ |
|---|---|
| $PbO_2$ on carbon | 79% |
| Pb with 3.5% Sn and 0.1% Ag | 80% |
| Pb - C.P. grade | 81% |
| Pb with 6% Sb | 87% |
| Pb with 4% Sn | 89% |
| Pb with 2% Sn and 0.05% Te | 94% |
| Pb with 7% Sn | 95% |

EXAMPLE IV

Panels of ABS plastic were etched in a solution containing 400 grams per liter of each of $CrO_3$ and $H_2SO_4$ until direct analysis indicated that the trivalent chromium had reached 46.2 grams per liter. A sample of this etch solution was then refluxed at 116° C. until no further increase in trivalent chromium was noted. At this point, it was found that the concentration of trivalent chromium had climbed to 62.4 grams per liter. Thus, it was established that this spent etchant contained an additional 16.2 grams per liter demand for hexavalent chromium due to dissolved organics. A portion of the spent etch was then diluted with an equal volume of water and subjected to electrochemical regeneration, as per conditions described in Example I. At the end of a 2.5 hour electrolysis period, the apparent trivalent chromium concentration was reduced from an initial value of 23.5 grams per liter to a final value of 7.8 grams per liter. The dilute etch solution was then returned to its original volume by vacuum distillation (82° C. and 0.5 atm.). In this case, no detectable increase in the total trivalent chromium content was noted on concentration. A sample of the regenerated etch solution was taken and refluxed at 116° C. to establish the hexavalent chromium demand that remained after electrolytic regeneration and concentration. It was found that the trivalent chromium concentration increased by 6.3 grams per liter or, in other words, the hexavalent chromium demand, due to dissolved organics, was reduced by 9.9 grams per liter during the regeneration process.

In the same manner, a second portion of this spent etch solution was subjected to this same regeneration sequence, with the exception that a current density of 1 amp per square decimeter was employed during electrolysis. After 6 hours of electrolysis, the apparent trivalent chromium concentration was reduced from 23.5 grams per liter to 17.9 grams per liter. On concentration, it was found that the apparent trivalent chromium content increased by 0.80 grams per liter due to oxidation of dissolved organics. Exhaustive reflux of this semi-regenerated solution at 116° C. produced only a 5 g/l increase in the trivalent chromium content. This corresponded to an 11.2 gram per liter reduction of the hidden hexavalent chromium demand.

It is obvious to those skilled in the art that many variations and modifications can be made to the method of this invention. All such departures from the foregoing specification are considered within the scope of this invention as defined by this specification and appended claims.

What is claimed is:

1. In a plastic etching process wherein plastic workpieces are subjected to etching by a chromic acid-sulfuric acid etchant solution in an etch zone and then rinsed with water in a rinse zone, and wherein during the course of the process the etchant solution and the rinse water become spent, the spent etchant being depleted in hexavalent chromium, enriched in trivalent chromium and contaminated with plastic organic breakdown products, the spent rinse water being enriched with such spent etchant, the method of at least partially removing such organic breakdown products from the spent etchant, while regenerating etchant for reuse within the plastic etching process, which method comprises:

withdrawing spent etchant from the etch zone and spent rinse water from the rinse zone;

diluting spent etchant with spent rinse water;

heating the diluted spent etchant to at least about 60° C.;

passing said heated diluted etchant solution into the anode chamber of an electrolytic cell, which contains a permselective ion exchange membrane which divides the cell into said anode chamber and a cathode chamber;

maintaining an aqueous sulfuric acid solution in the cathode chamber;

electrically energizing the solutions in the anode and cathode chambers by cooperating anode and cathode means;

oxidizing plastic organic breakdown products in said anode chamber at a temperature of at least 60° C. while preventing transfer of anions to the cathode chamber;

withdrawing a chromic acid-sulfuric acid solution, which is depleted in organic content and enriched in hexavalent chromium, from the anode chamber into an evaporation zone;

increasing the temperature of said chromic acid-sulfur acid solution in the evaporation zone to remove additional quantities of organic breakdown products, to evaporate water from said solution and to recover a reconcentrated regenerated chromic acid-sulfuric acid solution, and passing said concentrated solution to the etch zone.

2. The method of claim 1, wherein the water evaporated in the evaporation zone is returned to the rinse zone as regenerated rinse water.

3. A method according to claim 1 wherein the diluted spent etchant is heat treated at a temperature in the range from about 70° C. to about 150° C.

4. A method according to claim 1, wherein the chromic acid-sulfuric acid solution withdrawn from the anode chamber is heat treated in said evaporation zone at a temperature in the range from about 70° C. to about 150° C.

5. A method according to claim 1, wherein the anode material is selected from:

platinum, lead or lead alloys containing at least 90 percent by weight lead, or carbon or metallic substrates coated with platinum or lead peroxide.

6. A method according to claim 5, wherein the anode material is lead.

7. A method according to claim 5, wherein the anode material is an alloy of lead and at least one other metal selected from antimony, silver, tellurium or tin.

8. A method according to claim 5, wherein the anode material is lead peroxide coated on a carbon substrate.

9. A method according to claim 1, wherein agitation is provided in the anode chamber.

10. A method according to claim 1, wherein agitation is provided in the cathode chamber.

* * * * *